US012269523B2

(12) United States Patent
Jiang et al.

(10) Patent No.: US 12,269,523 B2
(45) Date of Patent: Apr. 8, 2025

(54) TACS SYSTEM SUPPORTING FALLBACK TRAIN CONTROL MODE AND MANUAL FAULT HANDLING MODE

(71) Applicant: CASCO SIGNAL LTD., Shanghai (CN)

(72) Inventors: Jianhua Jiang, Shanghai (CN); Xiang Chen, Shanghai (CN); Lei Feng, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 237 days.

(21) Appl. No.: 18/003,523

(22) PCT Filed: Sep. 22, 2021

(86) PCT No.: PCT/CN2021/119527

§ 371 (c)(1),
(2) Date: Dec. 28, 2022

(87) PCT Pub. No.: WO2022/241988

PCT Pub. Date: Nov. 24, 2022

(65) Prior Publication Data

US 2023/0249726 A1 Aug. 10, 2023

(30) Foreign Application Priority Data

May 19, 2021 (CN) ..... 202110544289.3

(51) Int. Cl.
*B61L 27/16* (2022.01)

(52) U.S. Cl.
CPC ..... *B61L 27/16* (2022.01)

(58) Field of Classification Search
CPC ..... B61L 15/0027; B61L 2027/204; B61L 27/16; B61L 27/20; B61L 27/33
See application file for complete search history.

(56) References Cited

U.S. PATENT DOCUMENTS 400,816 A * 4/1889 Alkins ..... B61L 5/02 74/46
6,032,905 A * 3/2000 Haynie ..... B61L 27/20 246/167 R (Continued)

FOREIGN PATENT DOCUMENTS

CN 110696876 A 1/2020
CN 111776013 A 10/2020

(Continued)

OTHER PUBLICATIONS

International Search Report (with English translation) and Written Opinion issued in PCT/CN2021/119527, dated Dec. 23, 2021, 9 pages provided.

*Primary Examiner* — Carl C Staubach
(74) *Attorney, Agent, or Firm* — HSML P. C.

(57) ABSTRACT

The present invention relates to a TACS system supporting a fallback train control mode and a manual fault handling mode. The system supports mixed running operation of a main mode train and a degraded mode train. The main mode is a TACS mode, and the degraded mode includes a fallback mode and a device cut-off mode. The TACS system includes a central train supervision device, a station train dispatching device, a wayside resource management unit RMU, a wayside target controller OC, a data communication system DCS, and an on-board controller CC. Compared with the prior art, the present invention has the advantages of improving the functionality and practicality of the system.

11 Claims, 3 Drawing Sheets

(56) References Cited

U.S. PATENT DOCUMENTS

| | | | | |
|---|---|---|---|---|
| 10,077,060 | B2 * | 9/2018 | Tonguz | B61L 19/06 |
| 10,259,478 | B1 * | 4/2019 | Gao | B61L 27/20 |
| 12,151,726 | B2 * | 11/2024 | Lu | B61L 23/14 |
| 2004/0249571 | A1 * | 12/2004 | Blesener | B61L 29/28 340/907 |
| 2006/0074544 | A1 * | 4/2006 | Morariu | B61L 27/16 701/19 |
| 2007/0219682 | A1 * | 9/2007 | Kumar | B61L 15/0058 701/19 |
| 2010/0023190 | A1 * | 1/2010 | Kumar | B61L 27/53 701/20 |
| 2015/0350454 | A1 * | 12/2015 | Suzuki | H04W 28/0231 370/329 |
| 2017/0113707 | A1 * | 4/2017 | Ghaly | B61L 23/14 |
| 2022/0227402 | A1 * | 7/2022 | Xu | H04W 4/42 |
| 2023/0249727 | A1 * | 8/2023 | Lu | B61L 27/20 701/19 |
| 2023/0271636 | A1 * | 8/2023 | Xu | B61L 15/0027 701/19 |
| 2023/0303139 | A1 * | 9/2023 | Pan | B61L 27/20 |
| 2023/0322282 | A1 * | 10/2023 | Feng | B61L 3/02 701/19 |
| 2024/0227888 | A1 * | 7/2024 | Shen | B61L 15/0027 |

FOREIGN PATENT DOCUMENTS

| | | | | |
|---|---|---|---|---|
| CN | 112249097 | A | 1/2021 | |
| CN | 113320575 | A | 8/2021 | |
| CN | 111497905 | A * | 6/2022 | B61L 27/70 |

* cited by examiner

TACS SYSTEM SUPPORTING FALLBACK TRAIN CONTROL MODE AND MANUAL FAULT HANDLING MODE

FIELD OF TECHNOLOGY

The present invention relates to the technical field of safety control of rail transit signals, and in particular relates to a TACS system supporting a fallback train control mode and a manual fault handling mode.

BACKGROUND

TACS (Train Autonomous Circumambulate System) system, by means of the train-train communication, can achieve the train autonomous control taking on-board devices as the main body, and achieve more accurate, efficient and rapid train operation control, while simplifying wayside devices and improving the system operation efficacy, and thus such system can be used in subways, suburban railways, interurban railways and high-speed railways. However, in a case that on-board devices have problem or lose communication with the ground, both a backup train control mode based on the ground device, such as interlocking fallback mode with track circuits or axle counters as train occupancy detection devices, and the manual fault handling and manual intervention on the ground must be considered. In an existing TACS system, there is not yet a perfect set of ways to support the ground fallback train control mode and manual fault handling mode.

The existing subway CBTC (Communication-based train control) system has a more mature way which is compatible with the CBTC mode, the fallback mode, and the manual fault handling. Therefore, learning from the handling mechanism of the fallback mode of the existing CBTC system to achieve the compatibility of the TACS system with the fallback train control mode and the fault handling mode so as to improve the function and practicability of the system, and inheriting the fallback train control mode and the fault handling mode of the CBTC system that users are familiar with, have become a technical problem to be solved.

SUMMARY

An objective of the present invention is to provide a TACS system supporting a fallback train control mode and a manual fault handling mode to overcome the defects in the prior art.

The objective of the present disclosure may be achieved through the following technical solution:

In accordance with one aspect of the present invention, a TACS system supporting a fallback train control mode and a manual fault handling mode is provided. The system supports mixed running operation of a main mode train and a degraded mode train, where the main mode is a TACS mode, and the degraded mode comprises a fallback mode and a device cut-off mode; the TACS system comprises a central train supervision device, a station train dispatching device, a wayside resource management unit RMU, a wayside target controller OC, a data communication system DCS, and an on-board controller CC.

The central train supervision device is configured to manage a full-line train plan to achieve train number tracking of the main mode train and the degraded mode train.

The station train dispatching device is configured to manage an intra-regional degraded mode train plan and automatic degraded mode train route setting, to provide a manual operation interface for a route or a section to an operator, and to provide an intra-regional section occupancy status to the central train supervision device.

The wayside resource management unit RMU is configured to manage the allocation and recovery of operation resources of the main mode train, to achieve the route management and manual fault handling of the degraded mode train, and to control a wayside device by means of the wayside OC.

The on-board controller CC is configured to perform train operation control.

The wayside target controller OC is configured to acquire a status of the wayside device while directly controlling the wayside device.

As a preferred technical solution, for the main mode train operation, the central train supervision device and the wayside resource management unit RMU communicate with the on-board controller CC by means of the data communication system DCS, respectively; the wayside resource management unit RMU communicates with the wayside target controller OC by means of the data communication system DCS; and the on-board controllers CC are in communication by means of the data communication system DCS.

As a preferred technical solution, for the degraded mode train operation, the central train supervision device communicates with the station train dispatching device by means of the data communication system DCS; the station train dispatching device communicates with the wayside resource management unit RMU by means of the data communication system DCS; the wayside resource management unit RMU communicates with the wayside target controller OC by means of the data communication system DCS; an LEU is controlled by the wayside target controller OC to send a train control message to an active transponder, and the on-board controller CC of the fallback mode train receives train control message information from the active transponder.

As a preferred technical solution, the central train supervision device is configured to send all train plans in the region to the station train dispatching device, and the central train supervision device is configured to send a current train plan to the CC of the main mode train.

As a preferred technical solution, the central train supervision device is configured to complete the train number tracking of the main mode train and the degraded mode train according to train position information sent by the main mode train CC and a section occupancy state sent by the station train dispatching device, and to provide train number tracking information in the region to the station train dispatching device.

As a preferred technical solution, the station train dispatching device is configured to automatically handle a route for the degraded mode train according to the train plan and the train number information in the region sent by the central train supervision device, thus providing a manual operation interface for the route and the section to the operator for the route setting, route canceling, section fault release and full station release.

As a preferred technical solution, the wayside resource management unit RMU comprises an interlocking train control module, a resource management module, and a target controller communication management module. The interlocking train control module and the resource management module respectively communicate with the wayside target controller OC by means of the target controller communication management module.

As a preferred technical solution, the interlocking train control module is configured to achieve route management of the degraded mode train, comprising route establishment, route canceling and automatic route release, and to perform corresponding inspection and to give an error alarm.

The interlocking train control module is configured to achieve manual fault handling, comprising section fault release and full station release.

The interlocking train control module is configured to provide a route, a section locking state, and train occupancy information to the station train dispatching device.

The interlocking train control module is configured to send route resource set application and release requests to the resource management module.

The interlocking train control module is configured to send a signal control command to the wayside target controller OC by means of the target controller communication module, thus obtaining a signal state and section occupancy state information.

As a preferred technical solution, the resource management module is configured to manage line train operation resources so as to complete resource conflict detection, resource allocation and recovery.

The resource management module is configured to send a switch control command to the wayside target controller OC by means of the target controller communication module so as to obtain a switch position status.

As a preferred technical solution, the on-board controller CC of the TACS mode train is configured to interact with on-board controllers CC of other TACS mode trains to share resources according to the train plan and allocated resources, thus achieving the autonomous control operation of the train.

The on-board controller CC of the fallback mode train is configured to receive the train control message from the active transponder so as to control the train operation.

The on-board controller CC in the device cut-off device does not control the train operation, and a driver drives the train manually as indicated by the signal.

Compared with the prior art, the present disclosure has the following advantages:

1. According to the present invention, a mature fallback train control mode and a manual fault handling mode are added in the existing TACS system to perfect the functionality and practicability of the system.
2. According to the present invention, the existing TACS system is less changed, thus the impact on the system is small.
3. According to the present invention, the fallback train control mode and fault handing mode of the CBTC system that user are familiar with are inherited, thus the TACS system provided by the present invention is easy to accept and convenient for training.
4. According to the present invention, the existing mature CBTC system is fully utilized, thus the workload for development is reduced, and the time for development is saved

DESCRIPTION OF THE EMBODIMENTS

The technical solutions of the embodiments of the present invention are clearly described below with reference to the accompanying drawings in the present invention. Apparently, the described embodiments are some rather than all of the embodiments of the present invention. On the basis of the embodiment of the present disclosure, all other embodiments obtained by the person of ordinary skill in the art without involving any inventive effort should fall within the scope of protection of the present disclosure.

The present invention relates to a TACS system supporting a fallback train control mode and a manual fault handling mode. In an existing TACS system with on-board devices as the main body, the control right is transferred to the ground control devices to achieve the management of the fallback mode trains and the fault trains in a route manner, thus completing the mixed running operation of the main mode (TACS mode) trains and degraded mode (fallback mode, device cut-off) trains.

Figure 1:
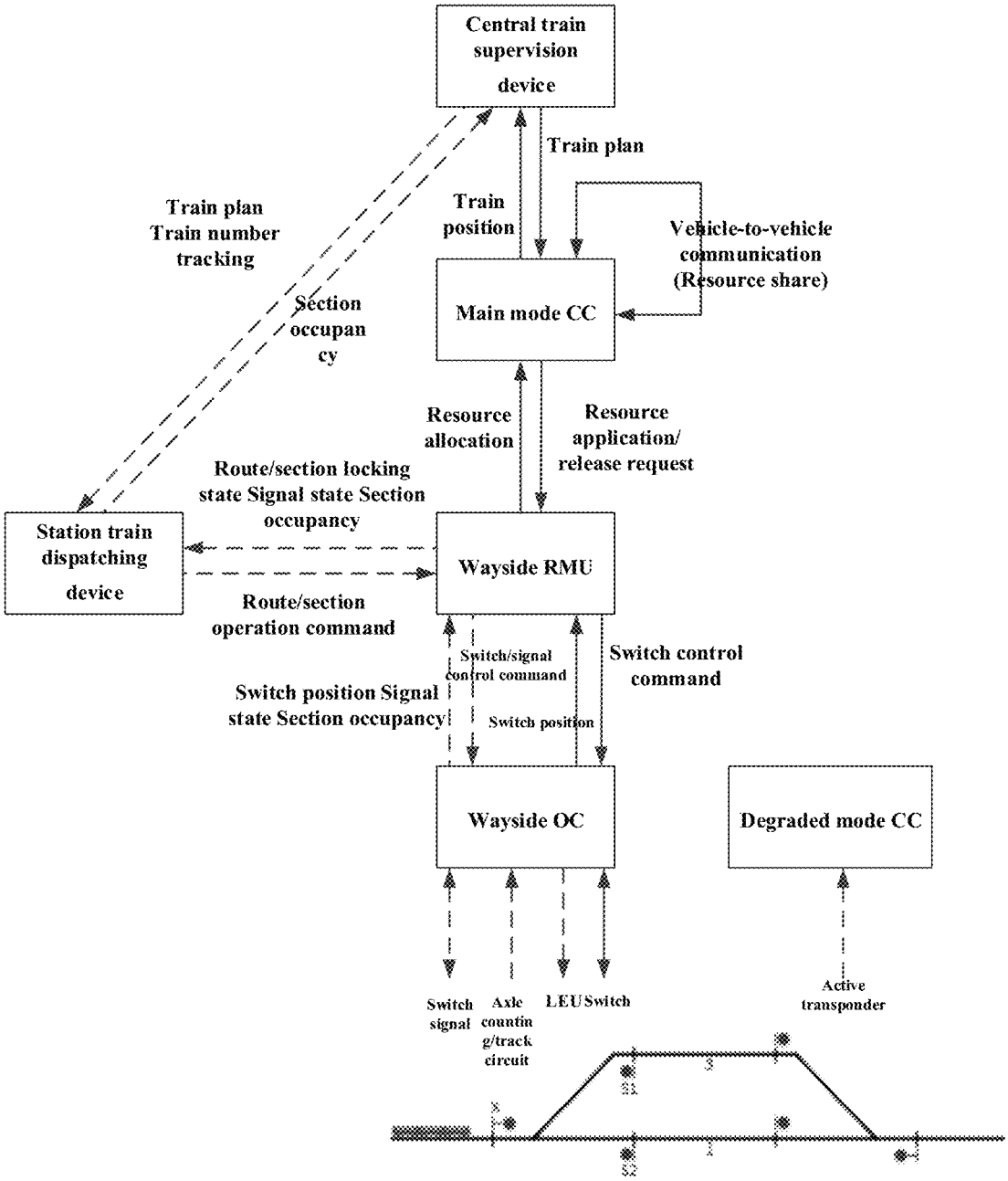
FIG. 1 is a structure diagram of a system in accordance with the present disclosure.

As shown in FIG. 1, the embodiment discloses a structure of a TACS system supporting a fallback train control mode and a manual fault handling mode. The system is composed of a central train supervision device, a station train dispatching device, a wayside resource management unit RMU, a wayside target controller OC, a data communication system DSC, and an on-board controller CC. The on-board controller CC includes two types: a CC of the main mode (TACS mode) train, and a CC of the degraded mode (fallback mode, device cut-off) train. The system supports the mixed running operation of the two different types of CCs.

In a specific example, during the TACS mode train operation, the central train supervision device is configured to interact with the CC of the TACS mode train for a train plan and train position information. The wayside RMU is configured to interact with the CC of the TACS mode train for a resource allocation state and a resource application/release request information. The wayside RMU is configured to interact with the wayside OC for a switch control command and switch position information. The CCs of the TACS mode train are configured to perform vehicle-vehicle communication for resource interaction and information sharing. The information interactions of the above subsystems are all completed by means of the DCS, the interactive information between the various subsystems in the system is shown in FIG. 1 in solid line.

During degraded mode (fallback mode, device cut-off) train operation, the central train supervision device is configured to interact with the station train dispatching device for a train plan, train number tracking and section occupancy information. The station train dispatching device is configured to interact with the wayside RMU for a route/section operation command, a route/section locking state, and the section occupancy information. The wayside RMU is configured to interact with the wayside OC for a switch/signal control command, a switch position, a signal state, and the section occupancy information. The information interactions of above subsystems are all completed by means of the DCS.

An LEU is controlled by the wayside OC to send a train control message to an active transponder, and the CC (fallback mode train) is configured to receive train control message information from the active transponder. The interactive information between various subsystems in the system is shown in FIG. 1 in dashed line.

In a specific example, the central train supervision device is configured to manage a full-line train plan. For the main mode (TACS mode) train, the central train supervision device is configured to send a train plan to the CC of the main mode (TACS model) train according to the position of the main mode (TACS mode) train. The central line supervision device is configured to send an intra-regional train plan to the station train dispatching device to facilitate the station train dispatching device to manage the intra-regional degraded mode (fallback mode, device cut-off) train plan.

The central train supervision device is configured to complete the full-line train number tracking according to train position information sent by the CC of the main mode (TACS mode) train operating in the line and an intra-regional section occupancy state sent by the station train dispatching device, and to send the intra-regional train number tracking information to the station train dispatching device.

In a specific example, the station train dispatching device is configured to manage the intra-regional degraded mode train plan. The station train dispatching device may set an operation route for the degraded mode (fallback mode, device cut-off) train by means of automatic route setting or manual route setting. The station train dispatching device is configured to automatically set a route for the degraded mode train according to the intra-regional train plan and the intra-regional train number information sent by the central train supervision device, and to provide a route operation interface for an operator for route setting and canceling operations, as well as to provide a manual fault handling interface (section fault release/full station release and the like) for fault recovery.

The station train dispatching device is configured to acquire a section occupancy state from the wayside RMU, and to provide the intra-regional section occupancy state to the central train supervision device for the train number tracking of the degraded mode (fallback mode, device cut-off) trains.

Figure 2:
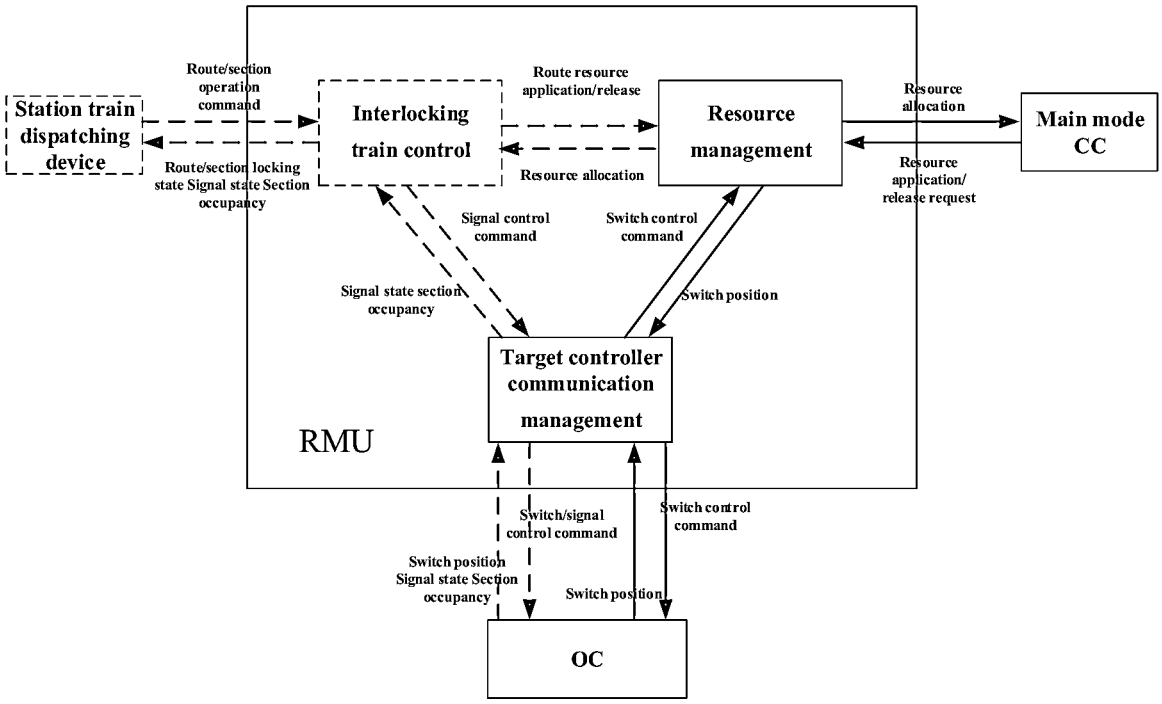
FIG. 2 is a structure diagram of a wayside RMU in accordance with the present disclosure.

In a specific example, the wayside RMU is configured to manage main mode (TACS mode) train operation resources to achieve the route management and manual fault handling (section fault release, full station release and the like) of the degraded mode (fallback mode, device cut-off device) trains, and the wayside device (e.g., switch, signal, LEU and the like) is controlled by the wayside OC. As shown in FIG. 2, the wayside RMU includes an interlocking train control module, a resource management module, and a target controller communication management module. The newly added interlocking train control module is configured to achieve route management and manual fault handling. The resource management module is configured to manage line traveling resources. The target controller communication management module is configured to enable the interlocking train control module and the resource management module to communicate with the wayside OC. The interactive information between the interlocking train control module, the resource management module, the target controller communication management module and an external system, and the interactive information between the various modules are shown in FIG. 2, where the solid line denotes the interactive information during the TACS model train operation, and the dotted line denotes the interactive information during the degraded mode (fallback mode, device cut-off mode) train operation.

Figure 3:
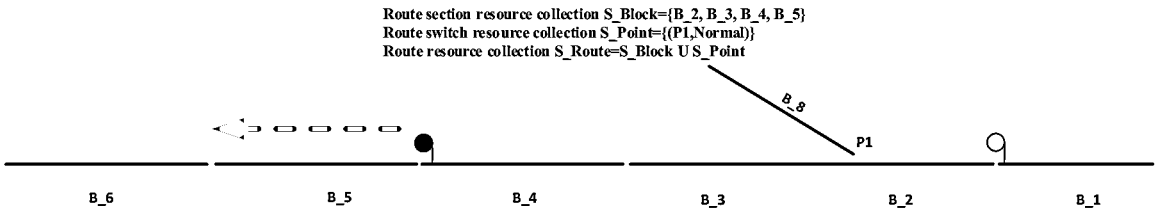
FIG. 3 is a schematic diagram of a route resource collection in accordance with the present disclosure.

In a specific example, the interlocking train control module is configured to receive a route setting command, to request a to-be-set route resource collection from the resource management module after checking that a to-be-set route has no adversarial relationship with the existing route. As shown in FIG. 3, the route resource collection includes a section resource and a switch resource. The resource management module is configured to allocate the to-be-set route resource collection to the interlocking train control module, the interlocking train control module is configured to check whether route locking conditions satisfy the establishment of the route or not, after a route signal open condition is satisfied, the OC is controlled by the target controller communication management module to open the route signal, and the route locking condition and the route signal open condition may reuse the existing CBTC system rules.

Route canceling/automatic route release/section fault release conditions may reuse the existing CBTC system rules. A signal state/section occupancy state is obtained by the target controller communication management module from the wayside OC. After route canceling/automatic route release/section fault release, the interlocking train control module is configured to request the release of the relevant resources from the resource management module, and the resources in the route resource collection may be released step by step during automatic route release.

When the route operation/manual operation command is executed incorrectly, the interlocking train control module is configured to return error warning information to the station train dispatching device. The interlocking train control module is configured to send an internal route/section locking state as well as a signal state/section occupancy state acquired from the OC to the station train dispatching device.

In a specific example, the source management module is configured to manage line train operation resources so as to complete resource conflict detection (the TACS mode train and the TACS mode train, the TACS mode train and the route), resource allocation and recovery.

The resource management module is configured to send a switch control command to the wayside OC by means of the target controller communication module, thus obtaining switch position information.

Figure 4:
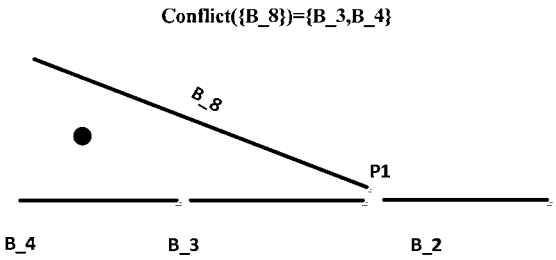
FIG. 4 is a schematic diagram of a conflict resource collection in accordance with the present disclosure.
Figure 5:
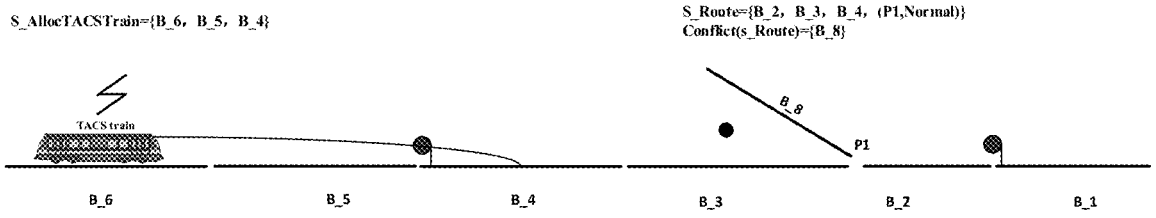
FIG. 5 is a schematic diagram illustrating route resource collection allocation conditions in accordance with the present disclosure.

The resource collection allocation operation in the resource request (interlocking train control module request/TACS mode train CC request) by the resource management module is an atomic operation. As shown in FIG. 5, when the resource management module receives a route resource request sent by the interlocking train control module, whether the following route resource collection allocation conditions are satisfied need to be checked:

$$S_Route \cap S_AllocTACSTrain = \emptyset$$

$$Conflit(S_Route) \cap S_AllocTACSTrain = \emptyset$$

Where S_Route denotes a route resource collection in the route resource request; S_AllocTACSTrain denotes a resource collection that has been allocated to the TACS mode train; referring to FIG. 4, Conflict(S_Route) denotes a resource collection that has a conflict relationship (such as side collision) with the route resource collection in the route resource request. When the above route resource collection allocation conditions are satisfied, the resource management module is configured to allocate all resources in the route resource collection to the interlocking train control module, otherwise, the resource management module does not allocate any resources in the route resource collection.

Figure 6:
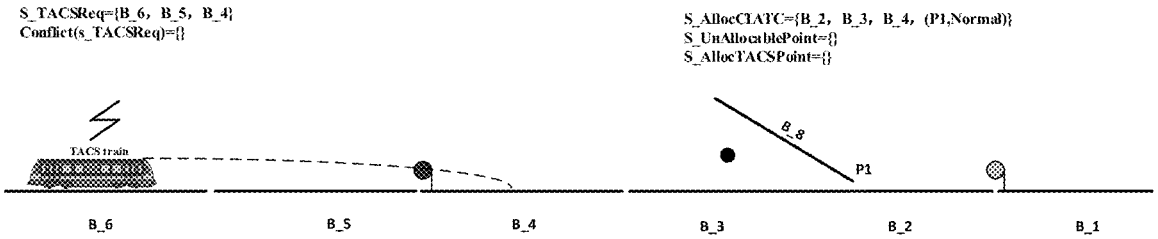
FIG. 6 is a schematic diagram illustrating TACS train resource collection application conditions in accordance with the present disclosure.

As shown in FIG. 6, when the resource management module receives a resource request sent by the CC of the main mode (TACS mode) train, whether the following route resource collection allocation conditions are satisfied need to be checked:

$S_TACSReq \cap S_UnAllocablePoint == \emptyset$ $S_TACSReq \cap S_AllocCIATC == \emptyset$ $Conflict(S_TACSReq) \cap (S_AllocTACSPoint \cup S_AllocCIATC) == \emptyset$ Where S_TACSReq denotes a resource collection in the resource request sent by the CC of the TACS mode train; S_UnAllocablePoint denotes a switch resource collection that can no longer be continuously allocated; S_AllocCIATC denotes a resource collection that has been allocated to the interlocking train control module; S_AllocTACSPoint denotes a switch resource collection that has been allocated to the TACS mode train; and Conflict(S_TACReq) denotes a resource collection that has a conflict relationship with the resource collection in the resource request sent by the CC of the TACS mode train. When the above resource collection allocation conditions requested by the CC of the TACS mode train are satisfied, the resource management module is configured to allocate all resources in the requested resource collection to the requesting TACS mode train; otherwise, the resource management module does not allocate any resources in the requested resource collection In a specific example, the CC of the TACS mode train is configured to interact with other TACS mode trains according to the train plan and allocated resources for resource sharing, thus achieving the autonomous control operation of the train. The fallback mode train CC is configured to acquire a message from the active transponder to control the train operation. The CC of the train without ATC device is not configured to control the train operation, and a driver drives the train manually as indicated by the signal.

In a specific example, the wayside OC is configured to drive the switch to move according to a switch control command sent by the wayside RMU, and to acquire a switch position to send to the wayside RMU. The wayside OC is configured to drive the signal on/off according to a signal control command sent by the wayside RMU, and to acquire a signal state to send to the wayside RMU. The wayside OC is required to drive a line electronic unit LEU associated with the route signal to send a train control message while driving the signal to open the signal. The wayside OC is configured to acquire a section occupancy state (axle counting/track circuit) and to send the section occupancy state to the wayside RMU.

The foregoing descriptions are merely specific implementations of the present invention, but are not intended to limit the scope of protection of the present invention. Any equivalent modification or replacement readily figured out by a person of ordinary skill in the art within the technical scope disclosed in the present invention shall fall within the scope of protection of the present invention. Therefore, the scope of protection of the disclosure shall be subject to the scope of protection of the claims.

The invention claimed is:

1. A Train Autonomous Circumambulate System (TACS) system supporting a fallback train control mode and a manual fault handling mode, the TACS system comprising:

a central train supervision device;

a station train dispatching device;

a wayside resource management unit RMU;

a wayside target controller;

a data communication system DCS; and an on-board controller, wherein the system supports mixed running operation of a main mode train and a degraded mode train, wherein the main mode train is a train operating in a main mode and the degraded mode train is a train operating in a degraded mode, wherein the main mode is a TACS mode, and the degraded mode comprises a fallback mode and a device cut-off mode;

the central train supervision device is configured to manage a full-line train plan to achieve train number tracking of the main mode train and the degraded mode train;

the station train dispatching device is configured to manage a degraded mode train plan and automatic degraded mode train route setting, to provide a manual operation interface for a route or a section, and to provide a section occupancy status to the central train supervision device;

the wayside resource management unit RMU is configured to manage the allocation and recovery of operation resources of the main mode train, to achieve the route management and manual fault handling of the degraded mode train, and to control a wayside device by means of the wayside target controller;

the on-board controller is configured to perform train operation control; and the wayside target controller is configured to acquire a status of the wayside device while directly controlling the wayside device.

2. The TACS system supporting the fallback train control mode and the manual fault handling mode according to claim 1, wherein, for the main mode train operation, the central train supervision device and the wayside resource management unit RMU communicate with the on-board controller by means of the data communication system DCS, respectively; the wayside resource management unit RMU communicates with the wayside target controller by means of the data communication system DCS; and on-board controllers are in communication by means of the data communication system DCS.

3. The TACS system supporting the fallback train control mode and the manual fault handling mode according to claim 1, wherein, for the degraded mode train operation, the central train supervision device communicates with the station train dispatching device by means of the data communication system DCS; the station train dispatching device communicates with the wayside resource management unit RMU by means of the data communication system DCS; the wayside resource management unit RMU communicates with the wayside target controller by means of the data communication system DCS; a line electronic unit is controlled by the wayside target controller to send a train control message to an active transponder, and the on-board controller of the fallback mode train is configured to receive train control message information from the active transponder.

4. The TACS system supporting the fallback train control mode and the manual fault handling mode according to claim 1, wherein the central train supervision device is configured to send all train plans to the station train dispatching device, and the central train supervision device is configured to send a current train plan to the on-board controller of the main mode train.

5. The TACS system supporting the fallback train control mode and the manual fault handling mode according to claim 1, wherein the central train supervision device is configured to complete the train number tracking of the main mode train and the degraded mode train according to train position information sent by the on-board controller of the main mode train and a section occupancy state sent by the station train dispatching device, and to provide train number tracking information to the station train dispatching device.

6. The TACS system supporting the fallback train control mode and the manual fault handling mode according to claim 1, wherein the station train dispatching device is configured to automatically set a route for the degraded mode train according to the train plan and the train number information sent by the central train supervision device, thus providing a manual operation interface for the route and the section for the route setting, route canceling, section fault release and full station release.

7. The TACS system supporting the fallback train control mode and the manual fault handling mode according to claim 1, wherein the resource management module is configured to manage line train operation resources so as to complete resource conflict detection, resource allocation and recovery;

the resource management module is configured to send a switch control command to the wayside target controller by means of the target controller communication module so as to obtain a switch position status.

8. The TACS system supporting the fallback train control mode and the manual fault handling mode according to claim 1, wherein the on-board controller of the TACS mode train is configured to interact with on-board controllers of other TACS mode trains to share resources according to the train plan and allocated resources, thus achieving the autonomous control operation of the train;

the on-board controller of the fallback mode train is configured to receive the train control message from the active transponder so as to control the train operation;

the on-board controller in the device cut-off device does not control the train operation, and a driver drives the train manually as indicated by the signal.

9. The TACS system supporting the fallback train control mode and the manual fault handling mode according to claim 1, wherein the interlocking train control module is configured to receive a route setting command, to request a to-be-set route resource collection from the resource management module after checking that a to-be-set route has no adversarial relationship with an existing route, wherein the route resource collection includes a section resource and a switch resource, the resource management module is configured to allocate the to-be-set route resource collection to the interlocking train control module, the interlocking train control module is configured to check whether route locking conditions satisfy an establishment of the route, wherein after a route signal open condition is satisfied, the wayside target controller is controlled by the target controller communication management module to open the route signal.

10. The TACS system supporting the fallback train control mode and the manual fault handling mode according to claim 1, wherein when a route operation command is executed incorrectly, the interlocking train control module is configured to return error warning information to the station train dispatching device, wherein the interlocking train control module is configured to send the section locking state and the section occupancy state acquired from the wayside target controller to the station train dispatching device.

11. A Train Autonomous Circumambulate System (TACS) system supporting a fallback train control mode and a manual fault handling mode, the TACS system comprising:

a central train supervision device;

a station train dispatching device;

a wayside resource management unit RMU;

a wayside target controller;

a data communication system DCS; and an on-board controller, wherein the system supports mixed running operation of a main mode train and a degraded mode train, wherein the main mode train is a train operating in a main mode and the degraded mode train is a train operating in a degraded mode, wherein the main mode is a TACS mode, and the degraded mode comprises a fallback mode and a device cut-off mode;

the central train supervision device is configured to manage a full-line train plan to achieve train number tracking of the main mode train and the degraded mode train;

the station train dispatching device is configured to manage a degraded mode train plan and automatic degraded mode train route setting, to provide a manual operation interface for a route or a section, and to provide a section occupancy status to the central train supervision device;

the wayside resource management unit RMU is configured to manage the allocation and recovery of operation resources of the main mode train, to achieve the route management and manual fault handling of the degraded mode train, and to control a wayside device by means of the wayside target controller;

the on-board controller is configured to perform train operation control; and the wayside target controller is configured to acquire a status of the wayside device while directly controlling the wayside device, wherein the wayside resource management unit RMU comprises an interlocking train control module, a resource management module, and a target controller communication management module; wherein the interlocking train control module and the resource management module respectively communicate with the wayside target controller by means of the target controller communication management module, wherein the interlocking train control module is configured to achieve route management of the degraded mode train, comprising route establishment, route canceling and automatic route release, and to perform corresponding inspection and to give an error alarm;

the interlocking train control module is configured to achieve manual fault handling, comprising section fault release and full station release;

the interlocking train control module is configured to provide a route, a section locking state, and train occupancy information to the station train dispatching device;

the interlocking train control module is configured to send route resource collection application and release requests to the resource management module;

the interlocking train control module is configured to send a signal control command to the wayside target controller by means of the target controller communication module, thus obtaining a signal state and section occupancy state information.

* * * * *